US006695192B1

(12) United States Patent
Kwok

(10) Patent No.: US 6,695,192 B1
(45) Date of Patent: Feb. 24, 2004

(54) ADJUSTABLE DEPTH CONTROL FOR FASTENER DRIVING TOOL

(75) Inventor: Kui-Chiu Kwok, Gurnee, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/261,022

(22) Filed: Sep. 30, 2002

(51) Int. Cl.[7] ..... B25C 1/08

(52) U.S. Cl. ..... 227/8; 142/130; 142/119; 142/107

(58) Field of Search ..... 227/142, 8, 130, 227/119, 107

(56) References Cited

U.S. PATENT DOCUMENTS

| | | | | |
|---|---|---|---|---|
| 3,572,572 A | * | 3/1971 | Readyhough et al. | 227/8 |
| 4,767,043 A | | 8/1988 | Canlas, Jr. | |
| 4,867,366 A | * | 9/1989 | Kleinholz | 227/130 |
| 5,261,587 A | | 11/1993 | Robinson | |
| 5,263,626 A | * | 11/1993 | Howard et al. | 227/142 |
| 5,320,268 A | * | 6/1994 | Shkolnikov et al. | 227/8 |
| 5,385,286 A | | 1/1995 | Johnson, Jr. | |
| 5,564,614 A | | 10/1996 | Yang | |
| 5,579,977 A | | 12/1996 | Yang | |
| 5,667,127 A | | 9/1997 | Ichikawa et al. | |
| 5,685,473 A | | 11/1997 | Shkolnikov et al. | |
| 5,743,455 A | | 4/1998 | Holliday | |
| 5,785,227 A | | 7/1998 | Akiba | |
| 5,799,855 A | | 9/1998 | Veoukas et al. | |
| 5,839,638 A | | 11/1998 | Ronn | |
| 5,909,836 A | * | 6/1999 | Shkolnikov et al. | 227/130 |
| 5,988,477 A | * | 11/1999 | Deieso et al. | 227/130 |
| 6,012,622 A | | 1/2000 | Weinger et al. | |
| 6,024,267 A | | 2/2000 | Chen | |
| 6,138,887 A | | 10/2000 | Nayrac et al. | |
| 6,145,727 A | * | 11/2000 | Mukoyama et al. | 227/142 |
| 6,170,729 B1 | | 1/2001 | Lin | |
| 6,186,386 B1 | | 2/2001 | Canlas et al. | |
| 6,427,896 B1 | | 8/2002 | Ho et al. | |
| 2002/0121540 A1 | | 9/2002 | Taylor et al. | |

* cited by examiner

*Primary Examiner*—Stephen F. Gerrity
*Assistant Examiner*—Michelle Lopez
(74) *Attorney, Agent, or Firm*—Lisa M. Soltis; Mark W. Croll; Donald J. Breh

(57) ABSTRACT

In a fastener driving tool having a novel depth of drive control is provided. The fastener driving tool includes a tool body having a cylinder with an axis, the cylinder enclosing a piston, wherein the piston is driven in a driving direction, a depth control probe, and a bumper associated with the depth control probe, wherein the bumper has a trailing surface. The depth control probe is movable relative to the tool body between an extended position and a retracted position, and the depth control probe creates a space having a predetermined length between a surface of a substrate and the trailing surface of the bumper. A surface of the piston hits the trailing surface of the bumper after the fastener has been driven to control the driving depth of a fastener.

15 Claims, 6 Drawing Sheets

ADJUSTABLE DEPTH CONTROL FOR FASTENER DRIVING TOOL

BACKGROUND OF THE INVENTION

1. Field of the Invention

The present invention is directed to a depth of drive control for use with a fastener driving tool, in particular to an adjustable depth of drive control for a fastener driving tool.

2. Description of the Related Art

Portable fastener driving tools for driving staples, nails and other fasteners are widely used for the attachment of substrates. Many fastener driving tools have attempted to control fastener driving depth. Effectively controlling driving depth has been difficult in the past because each fastener is usually driven with the same amount of energy each time that the tool is fired. This has been known to cause fasteners to be driven to an inconsistent depth when there was variation in the density of substrates into which the fasteners are to be driven, for example soft and hard woods. Additionally, it is desirable to be able to consistently select the depth to which the fastener will be driven depending on the application. For some applications it is desirable, for the sake of appearance, to drive the fasteners so they are countersunk below the surface of the substrate. For other applications it may be desirable to have the fastener head flush with the surface of the substrate, and for still other applications, it may be required for the fastener head to stand off from the surface of the substrate.

Several depth of drive controls have been described in the art, such as commonly assigned U.S. Pat. 5,261,587 and 6,012,622, to Robinson and Weinger et al., respectively, the disclosures of which are incorporated herein by reference. Similar fastener driving tools using depth of drive controls are available commercially from ITW-Duo-Fast and ITW-Paslode.

Many of the tools described above have a generally tool-shaped housing with a nosepiece. Depth control has been achieved in fastener driving tools through a tool controlling mechanism, commonly referred to as a drive probe, that is pressed against the surface of the substrate and that is axially movable in relation to the nosepiece in order to adjust the space between the substrate and the housing.

A problem that has been known to occur with many of the tools and depth controls described above is inconsistency in driving depth depending on how much driving and recoiling force is created. For example, many tools are able to alter the amount of driving energy provided, such as by increasing or decreasing the air pressure fed to the tool, which alters the driving depth of the fastener. Also, fastener driving tools, including the drive probe, are known to recoil away from the substrate after firing. Because the drive probe is an integral part of the tool body, the drive probe recoils with the tool body so that the drive probe is moving away from the substrate as the piston is driving the fastener. Tools have also been known to recoil at different speeds so that depth control of the fastener becomes less predictable because the piston is driven to different depths relative to the substrate surface.

Another problem that has occurred is inaccuracy when driving a fastener into a substrate. As a result of the recoil describe above, the drive probe leaves the surface of the substrate when the tool is fired, making a portion of the fastener-driving process unguided. Hence, the fastener may not be driven accurately and straight into the substrate.

Another problem has been known to occur when the piston finishes its first drive and contacts a portion of the tool. The driving energy is transferred forward, and an impact mark is left on the surface of the substrate by the tool. This phenomenon is commonly referred to as the "second strike."

What is needed is a depth of drive control for a fastener driving tool that will effectively, accurately, and consistently control the driving depth of a fastener under various operating conditions while being able to control the second.

BRIEF SUMMARY OF THE INVENTION

In accordance with the present invention, a fastener driving tool having a novel depth of drive control is provided. The fastener driving tool includes a tool body having a cylinder with an axis, wherein the cylinder encloses a piston, and wherein the piston is driven in a driving direction, a depth control probe, and a bumper associated with the depth control probe, the bumper having a trailing surface, wherein the depth control probe is movable with respect to the tool body between an extended position and a retracted position, wherein the depth control probe creates a space having a predetermined length between a surface of a substrate and the trailing surface of the bumper, and wherein a surface of the piston hits the trailing surface of the bumper after the fastener is driven.

Also in accordance with the present invention, a novel fastener driving tool for axially driving a fastener is provided. The fastener driving tool includes a tool body having a cylinder with an axis, the cylinder enclosing a bumper and a piston, wherein the piston is driven in a driving direction, wherein the tool body includes a lifting surface, a depth control probe having a substrate contacting surface and a recoil surface, wherein the depth control probe is movable with respect to the tool body between a retracted position and an extended position, wherein the recoil surface is spaced away from the lifting surface and the substrate contacting surface is in contact with a substrate when the depth control probe is in the retracted position, and wherein the lifting surface is in contact with the recoil surface, the substrate contacting surface is not in contact with the substrate, and the bumper is in contact with the piston when the depth control probe is in the extended position.

Also in accordance with the present invention, a method of controlling the driving depth of a fastener driving tool is provided. The method includes the steps of providing a fastener driving tool having a tool body with an axis, the tool body enclosing a piston, a depth control probe, a bumper associated with the depth control probe, the bumper having a trailing surface, wherein the depth control probe is movable relative to the tool body, and wherein the depth control probe creates a space of a predetermined length between a surface of a substrate and the trailing surface of the bumper, pushing the depth control probe against the surface of the substrate, firing the tool so that the piston is driven in a driving direction, driving a fastener in the driving direction with the piston, hitting the trailing surface of the bumper with the piston so that the piston is no longer moving in the driving direction.

These and other objects, features and advantages are evident from the following description of an embodiment of the present invention, with reference to the accompanying drawings.

DETAILED DESCRIPTION OF THE INVENTION

Figure 1:
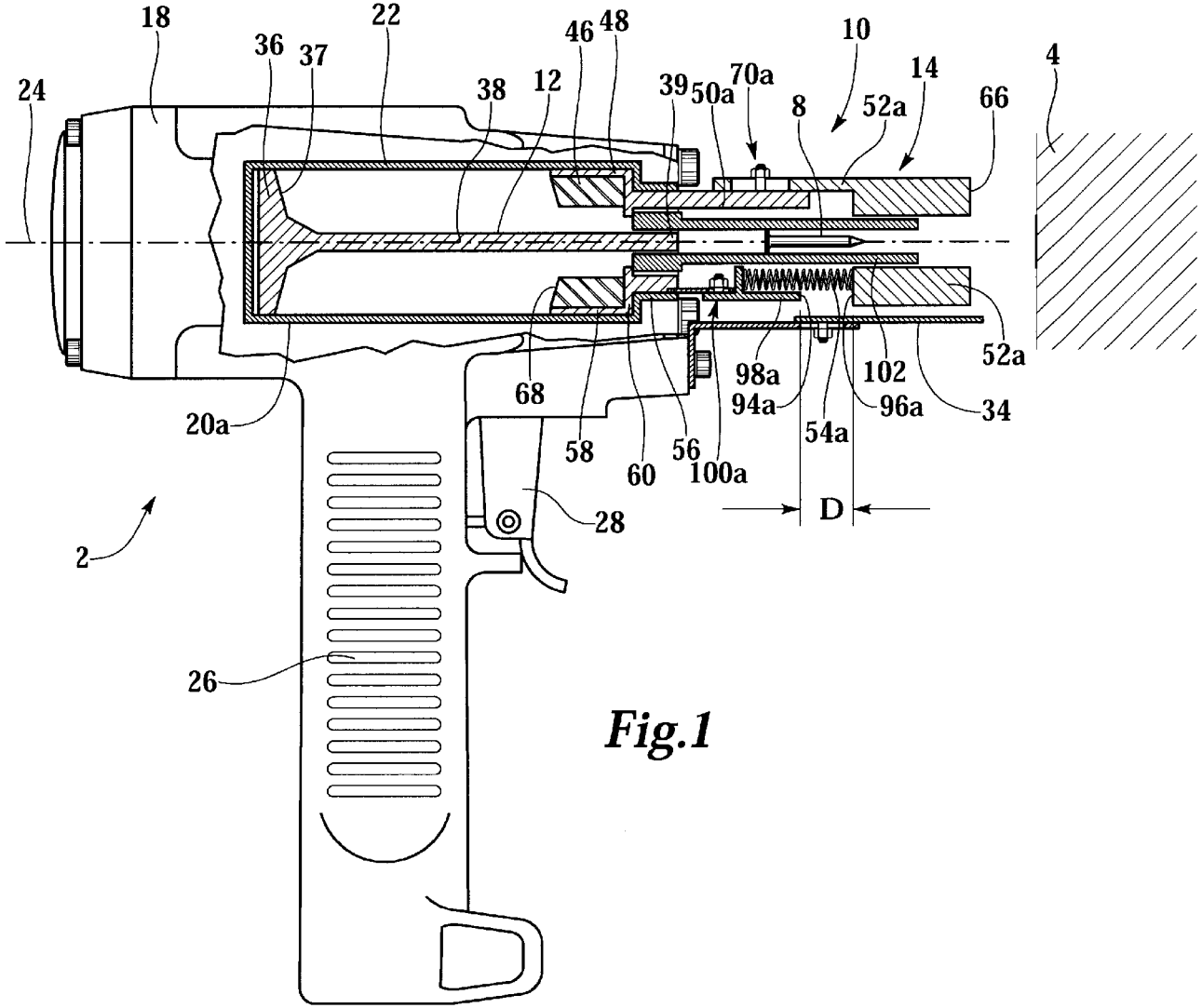
FIG. 1 is a partially cut-away side sectional view of the fastener driving tool having a first embodiment of a depth control.

Referring to FIG. 1, a novel and improved adjustable depth control 10 for a fastener driving tool 2 is shown. Adjustable depth control 10 uses a bumper 46 to stop the forward motion of a driving piston 12 and exploits the recoil of tool 2 to lift a depth control probe 14 off a substrate 4 into which a fastener 8 is being driven. Fastener driving tool 2 can be one of several types of tools for driving a fastener 8 into substrate 4, such as a gas combustion powered or powder actuated tool, but a preferred tool 2 is a pneumatically powered tool.

The right side of FIG. 1 is generally referred to as the driving side, because this is the side of tool 2 that piston 12 is driven towards, and the left side is generally referred to as the trailing side. Similarly, the direction in which piston 12 is driven (towards the right in the figures) is generally referred to as the driving direction, while the opposite direction is generally referred to as the trailing direction. However, tool 2 could be operated in several orientations, such as horizontal or vertical, without varying from the scope of the present invention.

Continuing with FIG. 1, tool 2 includes a housing 18 and a tool body 20*a* for enclosing a piston 12. Tool body 20*a* is generally cylindrical in shape and has a central axis 24 running through the length of tool 2. Housing 18 includes a handle 26 radially extending away from tool body 20*a* and a trigger 28 for actuating tool 2. Also included in tool 2 is a magazine (not shown) for feeding fasteners 8 to tool 2. Tool 2 may also include a trigger probe 34, which prevents tool 2 from being fired unless tool 2 is pushed against substrate 4.

Figure 2:
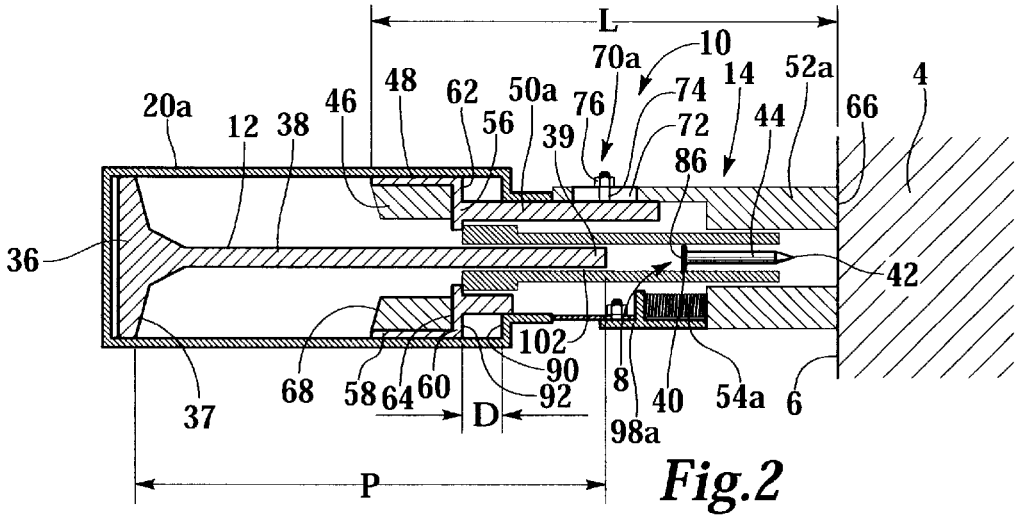
FIG. 2 is a side sectional view of the first embodiment of the depth control of the fastener driving tool (shown without a tool housing) before the tool is actuated.

Piston 12 includes a head 36 and a driving rod 38 for driving a fastener 8 into a substrate 4. Piston 12 is also generally cylindrical in shape and is aligned coaxially with axis 24 of tool body 20*a*. Piston head 36 includes a driving surface 37, which hits surface 68 of bumper 46, as described below. A representative fastener 8, shown in FIG. 2, has a head 40 at the trailing end of fastener 8, a point 42 at the driving end and a shank 44 axially extending between point 42 and head 40. A driving end 39 of piston rod 38 hits a trailing surface 86 of fastener head 40 in order to drive fastener 8 into a substrate 4. As shown in FIG. 2, piston 12 includes an extended length P between driving surface 37 of piston head 36 and driving end 39 of driving rod 38.

Referring back to FIG. 1, tool 2 includes a bumper 46 enclosed within tool body 20*a*. Bumper 46 protects piston 12 and tool body 20*a* from damage due to the high forces associated with tool 2. Bumper 46 is associated with the trailing end 56 of depth control probe 14 so that bumper 46 and depth control probe 14 move together. Bumper 46 can be connected to depth control probe 14 (not shown), or bumper 46 can be retained within a portion of depth control probe 14, such as a bumper holder 48 integral with depth control probe 14, or bumper 46 can be adjacent to depth control probe 14. Bumper 46 is also used by depth control 10 to stop the motion of piston 12 in the driving direction when driving surface 37 of piston head 36 hits bumper 46 which stops the driving of fastener 8 into substrate, as described below. Tool 2 is designed to stop the driving motion of piston 12 with bumper 46 immediately after piston 12 has driven fastener 8 to the desired depth.

Bumper 46 may be of any geometrical shape, but should have generally the same cross-sectional shape as piston 12 and tool body 20*a*. In one embodiment, bumper 46 has a generally cylindrical shape, with a generally annular cross section so that driving rod 38 can pass through bumper 46.

Bumper 46 may be made of any material that provides some elasticity to absorb shock from piston 12, is substantially heat resistant to the highest operating temperature created by friction within tool 2 and sufficiently wear resistant so that each bumper 46 may last for a substantial number of firings of tool 2 between change-outs. Although the material of bumper 46 should be chosen for its ability to consistently withstand the forces within tool 2, it eventually will wear down. Therefore, it is preferred that the material of bumper 46 be relatively inexpensive, allowing multiple change-outs to be cost-effective. A preferred material would be a resilient, polymeric plastic or rubber, an example being urethane.

Because tool 2 and tool body 20*a* will recoil away from substrate 4 when tool 2 is fired, as shown in FIGS. 1–4, tool 2 is designed so that depth control probe 14 will not recoil with tool body 20*a*, but rather will remain adjacent to substrate 4. Bumper 46 is retained by a bumper holder 48, which is operationally associated with depth control 10 so that bumper 46, bumper holder 48, and depth control probe 14 move together.

Continuing with FIG. 1, depth control probe 14 is generally cylindrical in shape and is aligned coaxially with tool body axis 24 and includes a trailing portion 50*a*, and an adjustable portion 52*a*. Adjustable portion 52*a* can be axially adjusted in the driving direction or the trailing direction relative to trailing portion 50*a* so that an effective length L, shown in FIG. 2, of depth control probe 14 and bumper 46 can be chosen in order to control the driving depth of fastener 8, as described below. Depth control probe 14 extends axially away from tool body 20*a* in the driving direction, as shown in FIG. 1, but depth control probe 14 is not fixedly connected to tool body 20*a*, as traditional nosepieces and drive probes usually are. Rather, depth control probe 14 can move in the axial direction independently of tool body 20*a* between an extended position, as shown in FIGS. I and 3, to a retracted position, shown in FIG. 2. Because depth control probe 14 moves independently from tool body 20*a*, depth control probe 14 does not recoil with tool body 20*a* so that depth control probe 14 can consistently and accurately control the driving depth and driving location of fastener 8, as described below. A spring 54*a* is included in order to bias depth control probe 14 toward the extended position. Spring 54*a* also biases depth control probe 14 to remain pushed against substrate 4 while tool body 20*a* recoils in the trailing direction.

Bumper holder 48 is connected to a trailing end 56 of depth control probe 14 so that bumper holder 48 is operationally associated with depth control probe 14 so that bumper holder 48 moves with depth control probe 14. In one embodiment, shown in FIG. 2, bumper holder 48 is integrally formed with trailing end 56 of trailing portion 50*a* of depth control probe 14. Bumper holder 48 is generally cylindrical in shape and has a cylindrical portion 58 with a flange 60 connected to the driving end of cylindrical portion 58, where flange 60 radially extends outwardly from trailing end 56 of depth control probe 14 to cylindrical portion 58 of bumper holder 48 so that flange 60 is an annulus formed between depth control probe 14 and cylindrical portion 58. Flange 60 of bumper holder 48 includes a leading surface 62 on the driving side of flange 60, and a trailing surface 64 for supporting bumper 46.

Figure 3:
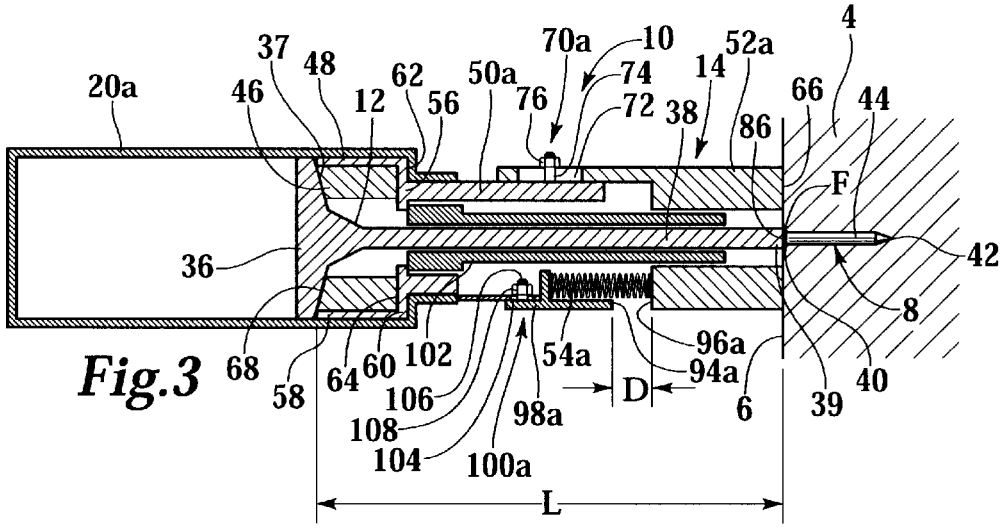
FIG. 3 is a side-sectional view of the first embodiment of the depth control (shown without the tool housing) after the fastener driving tool has been actuated, but before a lifting surface has started to lift a depth control probe off a substrate.

Turning to FIG. 3, as piston 12 is driven in the driving direction, tool body 20*a* moves in the trailing direction due to recoil and depth control probe 14, bumper holder 48 and bumper 46 remain essentially stationary, with a substrate contacting surface 66 of depth control probe 14 pushed against substrate 4 by spring 54*a*. Piston 12 moves in the driving direction until driving surface 37 of piston head 36 eventually hits a trailing surface 68 of bumper 46. At this point, driving end 39 of piston 12 has reached a farthest point F relative to depth control probe 14 and piston 12 cannot move any further in the driving direction because the driving energy in piston 12 has been dissipated by bumper 46.

Figure 4:
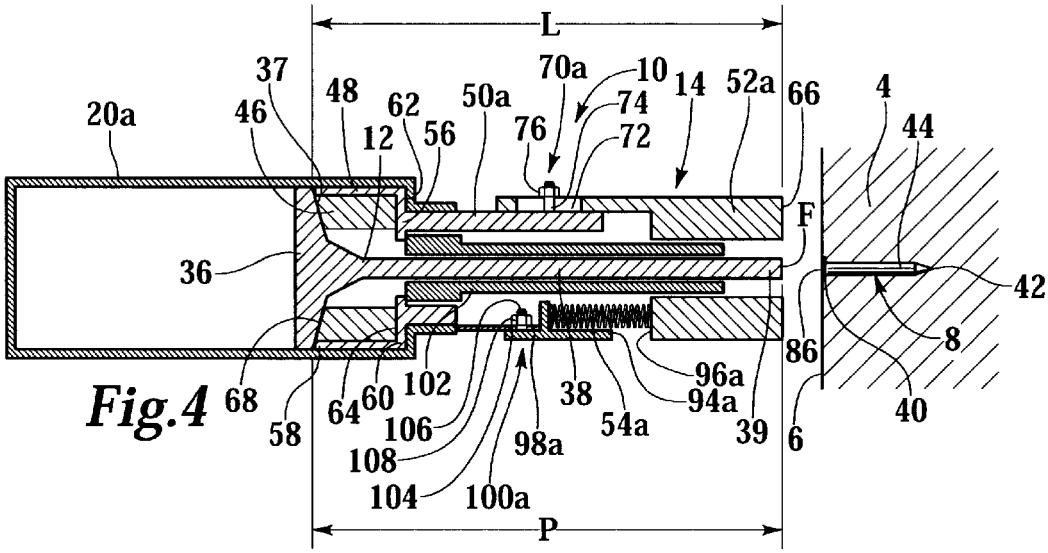
FIG. 4 is a side-sectional view of the first embodiment of the depth control (shown without the tool housing) after the lifting surface has lifted the depth control probe off the substrate.

Tool body 20*a* continues to recoil away from the substrate 4, carrying with it piston 12, bumper 46, and depth control probe 14, as shown in FIG. 4 and described below. When piston 12 is no longer providing driving energy to drive fastener 8 into substrate 4, friction between substrate 4 and shank 44 of fastener 8 effectively stops fastener 8 immediately after piston 12 has stopped providing driving energy so that fastener 8 will not be driven forward any further than it already has been by piston 12.

A trailing surface 68 of bumper 46 remains generally stationary at a predetermined length from surface 6 of substrate 4 equal to the effective length L of depth control probe 14 so that driving surface 37 of piston head 36 hits bumper 46 at the exact moment that driving end 39 of piston 12 has reached its farthest point F, causing fastener head 40 to be driven to the desired depth. In this way, depth control probe 14 creates a space of a predetermined length between substrate surface 6 and bumper 46 so that bumper 46 is at a predetermined axial position relative to substrate 4.

Depth control probe 14 includes a depth control adjustment 70*a*, 70*b* in order to axially adjust the effective length L of depth control probe 14 to control the driving depth of fastener 8, as described below. Depth control probe 14 includes a trailing portion 50*a*, 50*b* and an adjustable portion 52*a*, 52*b* that is adjustably connected to trailing portion 50*a*, 50*b* so that adjustable portion 52*a*, 52*b* axially extends in the driving direction away from trailing portion 50*a*, 50*b*.

In one embodiment, shown in FIGS. 1–4, depth control adjustment 70*a* includes an adjustment slot 72 in adjustable portion 52*a*, a threaded bolt 74 connected to trailing portion 50*a*, wherein bolt 74 fits into slot 72, and a nut 76 placed on bolt 74. Adjustment slot 72 extends in the axial direction so that when nut 76 is loosened, bolt 74 can slide freely along slot 72. When a desired effective length L of depth control probe 14 is achieved, nut 76 is tightened so that it forces adjustable portion 52*a* tight against trailing portion 50*a*, causing both portions to be locked together so that they move together. An alternative of this embodiment (not shown) is an adjustable slot in trailing portion 50*a* with the bolt being connected to adjustable portion 52*a*. This alternative performs the same function of axially adjusting the length L of depth control probe 14 and would not vary from the scope of the present invention.

Figure 6:
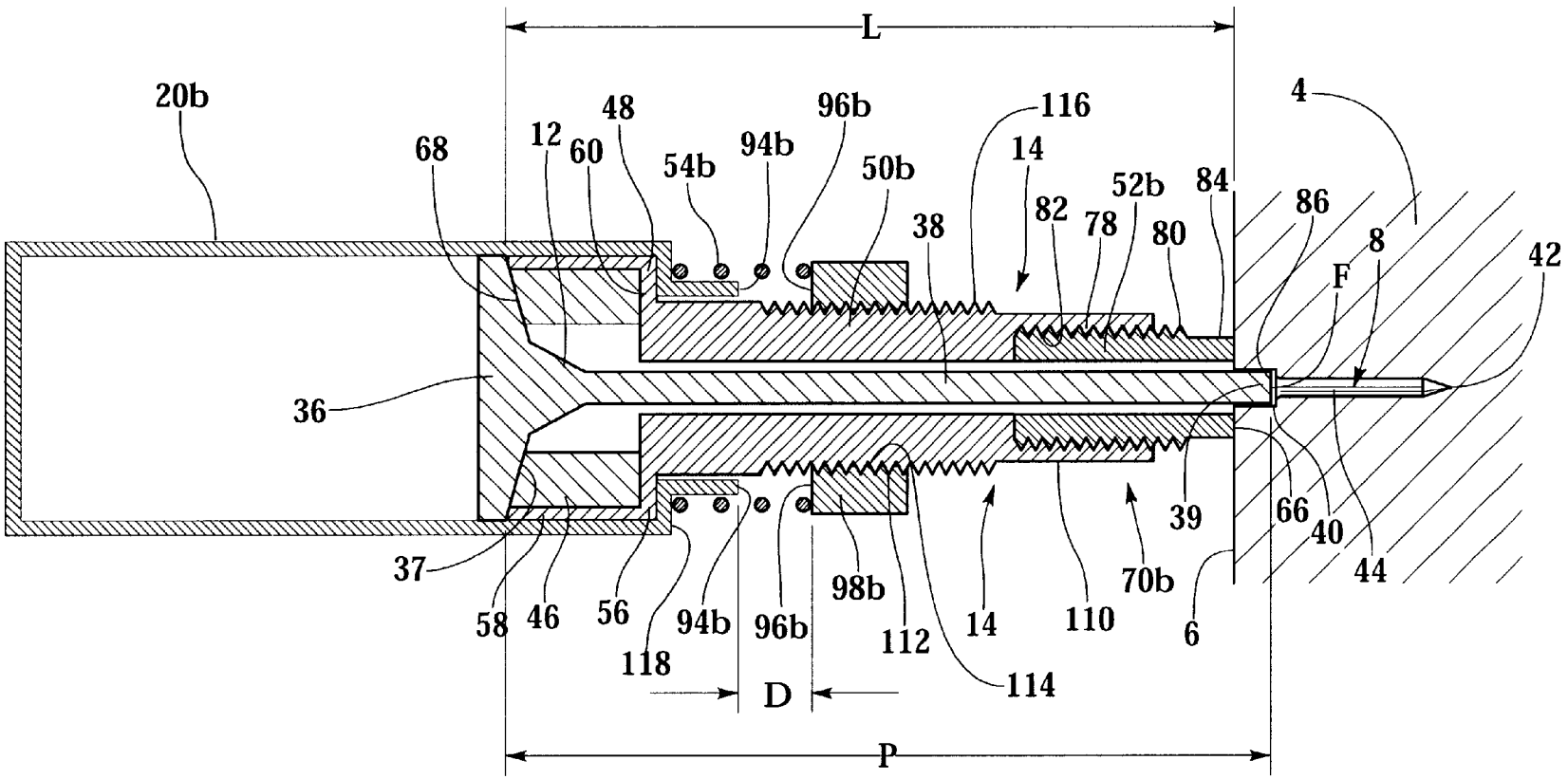
FIG. 6 is a side-sectional view of the second embodiment of the depth control (shown without the tool housing) in a first predetermined setting after the fastener driving tool has been actuated, shown with a driven fastener.
Figure 7:
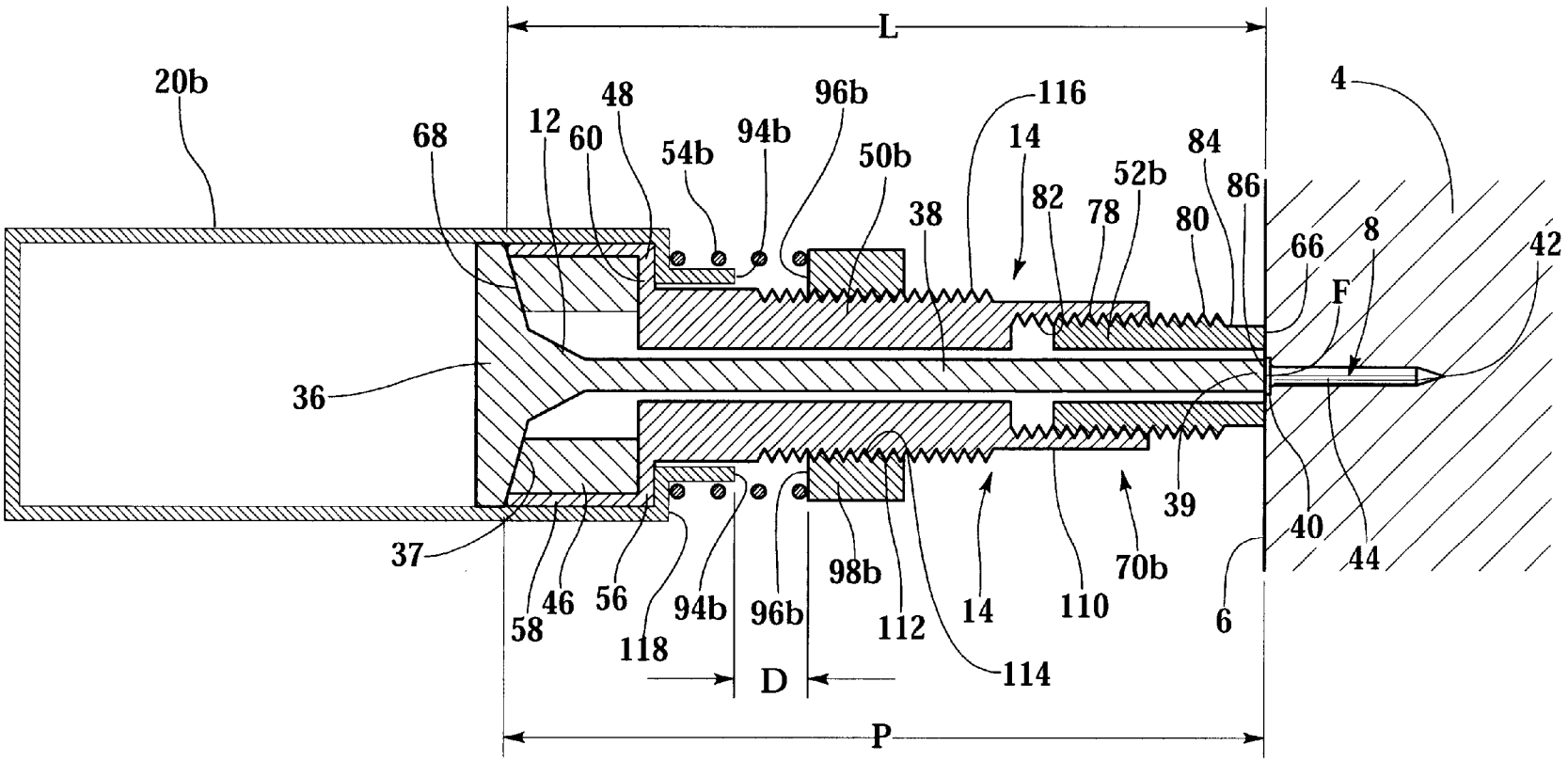
FIG. 7 is a side-sectional view of the second embodiment of the depth control (shown without the tool housing) in a second predetermined setting after the fastener driving tool has been actuated, shown with a driven fastener.
Figure 8:
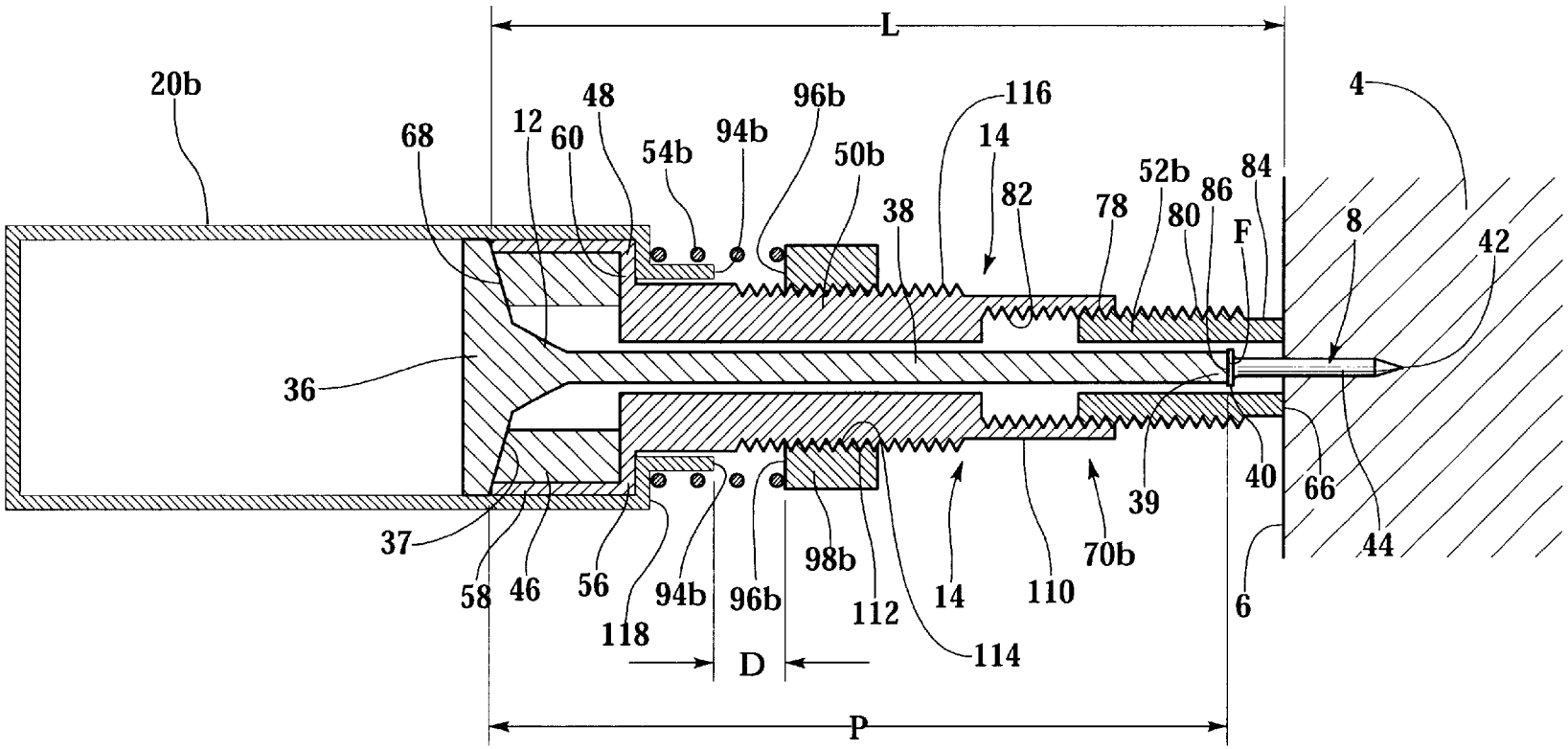
FIG. 8 is a side-sectional view of the second embodiment of the depth control (shown without the tool housing) in a third predetermined setting after the fastener driving tool has been actuated, shown with a driven fastener.

Turning to FIGS. 6–8, another embodiment of depth control adjustment 70*b* includes threading 78 on the driving end of trailing portion 50*b* and corresponding threading 80 included on the trailing end of adjustable portion 52*b*, so that one fits radially within the other. The axial length L of depth control probe 14 is adjusted by rotating adjustable portion 52*b* with respect to trailing portion 50*b*, which causes adjustable portion threading 80 to engage trailing portion threading 78 so that adjustable portion 52*b* moves either in the driving direction or the trailing direction with respect to trailing portion 50*b*, depending on which direction adjustable portion 52*b* is rotated.

FIGS. 6–8 show trailing portion threading 78 being on interior surface 82 of trailing portion 50*b* and adjustable portion threading 80 being on an exterior surface 84 of adjustable portion 52*b*. The diameter of trailing portion threading 78 is slightly larger than the diameter of adjustable portion threading 80 so that adjustable portion threading 80 can be threadingly engaged radially within trailing portion threading 78.

However, an alternative embodiment (not shown) wherein the trailing portion threading is on an exterior surface of the trailing portion while the adjustable portion threading is on an interior surface of the adjustable portion is employed. The diameter of the adjustable portion threading is slightly smaller than the diameter of the trailing portion threading so that the trailing portion threading can be threadingly engaged radially within the adjustable portion threading.

Continuing with FIGS. 6–8, the relationship between the extended length P of piston 12 between driving surface 37 of piston head 36 and driving end 39 and the effective length L of depth control probe 14 determines the driving depth of fastener 8. Depth control adjustment 70*b* can adjust the effective length L of depth control probe 14 to at least three predetermined settings.

In a first setting, shown in FIG. 6, depth control probe 14 is set so that substrate contacting surface 66 is in the trailing direction with respect to driving end 39 of piston 12 at its farthest point F. The effective length L of depth control probe 14 in the first setting is shorter than the extended length P of piston 12 so that the farthest point F is below, or in the driving direction of substrate surface 6. When the tool is actuated while depth control probe 14 is set at the first setting, trailing surface 86 of head 40 will be driven below surface 6 of substrate 4 to a distance equal to the difference between length L and extended length P.

FIG. 7 shows a second setting where substrate contacting surface 66 of depth control probe 14 is set so that it is essentially flush with driving end 39 of driving rod 38. When depth control 14 is set at the second setting, the effective length L of depth control probe 14 is essentially equal to the extended length P of piston 12 so that the farthest point F is even with substrate surface 6. When the tool is actuated while depth control probe 14 is in the second setting, a trailing surface 86 of fastener head 40 is flush with surface 6 of substrate 4.

In a third setting, shown in FIG. 8, depth control probe 14 extends past driving end 39 of driving rod 38 when piston 12 is in its fully driven position. When tool 2 is set in the third setting, the effective length L of depth control probe 14 is longer than the extended length P of piston 12 so that the farthest point F is in the trailing direction of substrate surface 6. When depth control probe 14 is set in the third setting, trailing surface 86 of head 40 will stand off above the surface 6 of substrate 4 at a distance equal to the difference between extended length P and length L.

As shown in FIGS. 6–8, depth control probe 14 creates a space, either in the trailing or the driving direction, between surface 6 of substrate 4 and the farthest point F that piston 12 can reach, allowing the position of point F relative to substrate surface 6 to be changed. For example, when depth control adjustment 70*b* is in its third setting so that fastener head 40 will stand off from surface 6 of substrate 4, depth control probe 14 creates a space between surface 6 and tool 2 so that the farthest point F that piston driving end 39 can reach is above surface 6, as shown in FIG. 8.

Turning back to FIGS. 2 and 5, it has been found that spacing bumper 46 away from substrate surface 6 by a predetermined length L, and by designing tool 2 so that bumper 46 does not recoil with tool body 20*a*, 20*b*, allows depth control 10 of the present invention to effectively and consistently control the driving depth so that fastener 8 will be driven to the desired depth regardless of the type of substrate 4 being driven into. Surprisingly, this has been found to be true even if tool 2 is being used to drive fastener 8 into a soft and thin substrate 4, such as a piece of plywood as thin as an eighth of an inch.

For some applications it may be desirable to prevent depth control probe 14 from leaving an impact mark on substrate surface 6. In still other applications it may be desirable to leave a controlled and exact impact mark on the substrate surface, such as to leave a distinct design, or "signature mark." The present invention can accurately control the formation of impact marks on the surface of a substrate. This novel feature advantageously uses the recoil created by the tool 2 to lift depth control probe 14 off substrate 4 at a desired moment.

In a pneumatic tool 2, as shown in FIG. 1, compressed air is fed into cylinder 22. The compressed air exerts a force on both piston 12 and tool body 20*a*, creating a driving force on piston 12 in the driving direction and a reactive force on the tool body 20*a* in the trailing direction, where the trailing motion of tool body 20*a* is commonly referred to as recoil. Because tool body 20*a* has a substantially higher mass than piston 12, piston 12 will travel in the driving direction much faster than tool body 20*a* will travel in the trailing direction. In one embodiment, after firing, piston 12 will have traveled about 4 inches in the driving direction while tool body 20*a* will have traveled less than about 0.5 inches in the trailing direction.

Referring to FIGS. 2–4, in order to take advantage of the recoil of tool 2 to control impact marks, a lifting surface 90 is included that uses the recoil motion of tool body 20*a* to lift depth control probe 14 off surface 6 of substrate 4. Lifting surface 90 faces generally in the trailing direction and is operationally associated with tool body 20*a* so that when tool body 20*a* recoils in the trailing direction, lifting surface 90 also moves in the trailing direction. Depth control 10 also includes a recoil surface 92 that faces generally in the driving direction and is operationally associated with depth control probe 14 so that when recoil surface 92 moves so does depth control probe 14.

At some point before tool 2 is actuated, shown in FIG. 2, lifting surface 90 and recoil surface 92 are axially spaced apart by a distance D. When tool 2 is fired, recoil causes tool body 20*a* to move in the trailing direction and lifting surface 90 moves with tool body 20*a*. As tool body 20*a* and lifting surface 90 recoil in the trailing direction, recoil surface 92 is biased by spring 54*a* to remain essentially stationary. Eventually, the distance D between lifting surface 90 and recoil surface 92 is closed by the recoil motion of lifting surface 90, as in FIG. 3, and lifting surface 90 engages recoil surface 92, lifting depth control probe 14 off substrate 4, as in FIG. 4.

In order to ensure that lifting surface 90 hits recoil surface 92, as in FIG. 3, at the desired moment, depth control 10 includes a spacing surface 94*a* facing generally in the driving direction and a stopping surface 96*a* facing generally toward spacing surface 94*a* in the trailing direction. Spacing surface 94*a* is operationally associated with tool body 20*a* so that spacing surface 94*a* moves when tool body 20*a* moves, and stopping surface 96*a* is operationally associated with depth control probe 14 so that stopping surface 96*a* moves when depth control probe 14 moves.

Turning to FIGS. 3 and 6, a spacer 98*a*,98*b*, which may also be known as a recoil travel adjustment, could be operationally connected to tool body 20*a*, as shown in FIGS. 3, or with depth control probe 14, as shown in FIG. 6. Also, spacer 98*a* could include spacing surface 94*a* and not stopping surface 96*a*, as in FIGS. 3, where stopping surface 96*a* is present on depth control probe 14, or spacer 98*b* could include stopping surface 96*b* and not spacing surface 94*b*, as shown in FIG. 6, where spacing surface 94*b* is present on tool body 20*b*. It is important that spacing surface 94*a*,94*b* and stopping surface 96*a*,96*b* are present, and that they are axially spaced apart by the distance D when depth control probe 14 is in the extended position, so that when depth control probe 14 is pushed against substrate 4, depth control probe 14 moves in the trailing direction relative to tool body 20*a*,20b until stopping surface 96*a*,96*b* is pushed against spacing surface 94*a*,94*b*, causing recoil surface 92 to be pushed apart from lifting surface 90 so that the recoil surface 92 and lifting surface 90 are axially spaced apart by the same distance D.

Turning to FIG. 3, preferably, spacer 98*a* includes a spacer adjustment 100*a* that allows spacer 98*a* to be axially adjusted so that lifting surface 90 of tool body 20*a* hits recoil surface 92 at a desired moment in order to control the formation of an impact mark, as described below. Spacer adjustment 100*a* allows the distance D, described above, to be increased or decreased so that lifting surface 90 hits recoil surface 92 at a desired moment after piston 12 has been driven.

For example, if it is desired that no impact mark be created on substrate surface 6, spacer 98*a* is adjusted so that the distance D between stopping surface 96*a* and spacing surface 94*a* is short enough so that lifting surface 90 hits recoil surface 92 and begins lifting depth control probe 14 immediately after driving surface 37 of piston head 36 hits bumper 46 and has driven fastener 8 to the desired depth. Alternatively, if an impact mark is desired, to leave a signature mark, spacer 98*a* is adjusted so that the distance D is larger than the above case, so that lifting surface 90 strikes recoil surface 92 slightly after driving surface 37 of piston head 36 has hit bumper 46. When driving surface 37 of piston head 36 hits bumper 46 before lifting surface 90 begins to lift depth control probe 14 off substrate 4, some of the driving energy of piston 12 is transferred to depth control probe 14, causing a substrate contacting surface 66 to be driven into substrate 4, leaving an impact mark.

Two embodiments of the present invention are shown in FIGS. 2 through 6 that are exemplary of the exploitation of the recoil motion of tool body 20*a*,20*b* to lift depth control probe 14 off substrate 4. In one embodiment of depth control 10, shown in FIGS. 1–4, tool body 20*a* includes a nosepiece 102 connected to, and aligned coaxially with tool body 20*a* and axially extending in the driving direction away from tool body 20*a*, where nosepiece 102 guides piston rod 38 and fastener 8 as piston 12 is driven in the driving direction. Flange 60 of bumper holder 48 includes recoil surface 92 on the driving side of flange 60, and tool body 20*a* includes an annular interior surface 90 within cylinder 22 that corresponds to recoil surface of bumper holder 48. An interior surface 90 of tool body 20*a* faces generally in the trailing direction and acts as lifting surface 90. Lifting surface 90 of tool body 20*a* is on the driving side of flange 60 so that it will recoil into recoil surface 92 to lift bumper holder 48, and therefore depth control probe 14 in the trailing direction.

Before tool 2 is used, shown in FIG. 1, depth control probe 14 is in an extended position relative to tool body 20*a* with recoil surface 92 of flange 60 being abutted against lifting surface 90. Depth control probe 14 is connected to bumper holder 48 so that depth control probe 14 axially extends in the driving direction toward substrate 4. Neither depth control probe 14 nor bumper holder 48 are connected to tool body 20*a*, so that they both can move axially with respect to tool body 20*a*.

As shown in FIGS. 2–4, spacer 98*a* is coupled to the driving end of tool body 20*a* so that spacer 98*a* extends axially in the driving direction away from tool body 20*a* towards substrate 4. Spacing surface 94*a* is located on the driving end of spacer 98*a* and stopping surface 96*a* is located on the trailing end of a portion of depth control probe 14, as shown in FIG. 2. Spacer 98*a* extends away from tool body 20*a* in the driving direction to a distance that is less than the distance depth control probe 14 extends from bumper holder 48 so that a space of distance D is created between spacer 98*a* and depth control probe 14.

When depth control probe 14 is pressed against substrate 4, as shown in FIG. 2, tool body 20*a* is pushed in the driving direction so that depth control probe 14 is pushed into the retracted position wherein stopping surface 96*a* is pushed against spacing surface 94a. When this happens, recoil surface 92 on bumper holder 48 is separated from lifting surface 90 on tool body 20*a* while bumper holder 48 remains essentially stationary so that a space having the same distance D is created between recoil surface 92 of bumper holder 48 and lifting surface 90 of tool body 20*a*.

At this point, tool 2 can be actuated so that piston 12 is driven in the driving direction, shown in FIG. 3. As piston 12 moves in the driving direction, it drives fastener 8 into substrate 4. As described above, tool body 20*a* recoils in the trailing direction, while a spring 54*a* placed between spacer 98*a* and depth control probe 14 acts to bias depth control probe 14 towards substrate 4 to ensure that depth control probe 14 and bumper 46 do not recoil with tool body 20*a*, but rather remain pushed against substrate 4. Eventually, driving surface 37 of piston head 36 hits bumper 46 when piston 12 has driven fastener 8 to the desired driving depth. As tool body 20*a* recoils in the trailing direction, lifting surface 90 eventually hits recoil surface 92 on bumper holder 48 to lift depth control probe 14 off substrate surface 6.

Preferably, spacer 98*a* includes a spacer adjustment 100*a*, shown in FIGS. 3 and 4, that allows the length of spacer 98*a* to be axially adjusted so that the moment when lifting surface 90 of tool body 20*a* hits recoil surface 92 of bumper holder 48 can be controlled, depending on whether an impact mark is desired or not. Spacer adjustment 100*a* includes an axially extending adjustment slot 104, a bolt 106 and a nut 108. When nut 108 is loosened, bolt 106 can freely slide along slot 104 until it reaches a desired location. Nut 108 can then be tightened to lock spacer adjustment 100*a* in place.

Even after hitting bumper holder 48, as in FIG. 3, tool body 20*a* still has sufficient momentum to continue moving in the trailing direction. When this happens, lifting surface 90 carries bumper holder 48 and depth control probe 14 with it so that substrate contacting surface 66*a* of depth control probe 14 is lifted off surface 6 of substrate 4, as shown in FIG. 4. As described above, trailing surface 68 of bumper 46 is also in contact with driving surface 37 of piston head 36 so that piston 12 is also lifted away from surface 6 of substrate 4.

Another embodiment of depth control 10 is shown in FIGS. 5–8. In this embodiment, no nosepiece is present with tool body 20*b*, and piston rod 38 is guided by depth control probe 14. Flange 60 of bumper holder 48 still includes recoil surface 92, and interior surface 90 of tool body 20*b* still acts as lifting surface 90, however spacer 98*b* is associated with depth control probe 14, rather than the tool body.

Turning to FIG. 6, spacer 98*b* is threadingly engaged with an exterior surface 110 of depth control probe 14. Spacer 98*b* is generally annular in shape and includes spacer threading 112 on an interior surface 114. Exterior surface 110 of depth control probe 14 also includes threading 116 that corresponds to spacer threading 112. Spacer 98*b* is axially adjusted by rotating spacer 98*b* relative to depth control probe 14 so that spacer threading 112 engages threading 116 on depth control probe 14 so that spacer 98*b* moves in the driving direction or the trailing direction depending on which direction spacer 98*b* is rotated. Stopping surface 96*b* is located on the trailing side of spacer 98*b*, corresponding to spacing surface 94*b* located on the driving end of tool body 20*b*.

When tool 2 is not in operation, a spring 54b biases depth control probe 14 into its extended position by acting between a leading surface 118*b* of tool body 20*b* and stopping surface 96*b* on spacer 98*b*, which causes recoil surface 92 to be biased toward lifting surface 90. As shown in FIG. 6, stopping surface 96*b* and spacing surface 94*b* are axially spaced by a distance of D.

Figure 5:
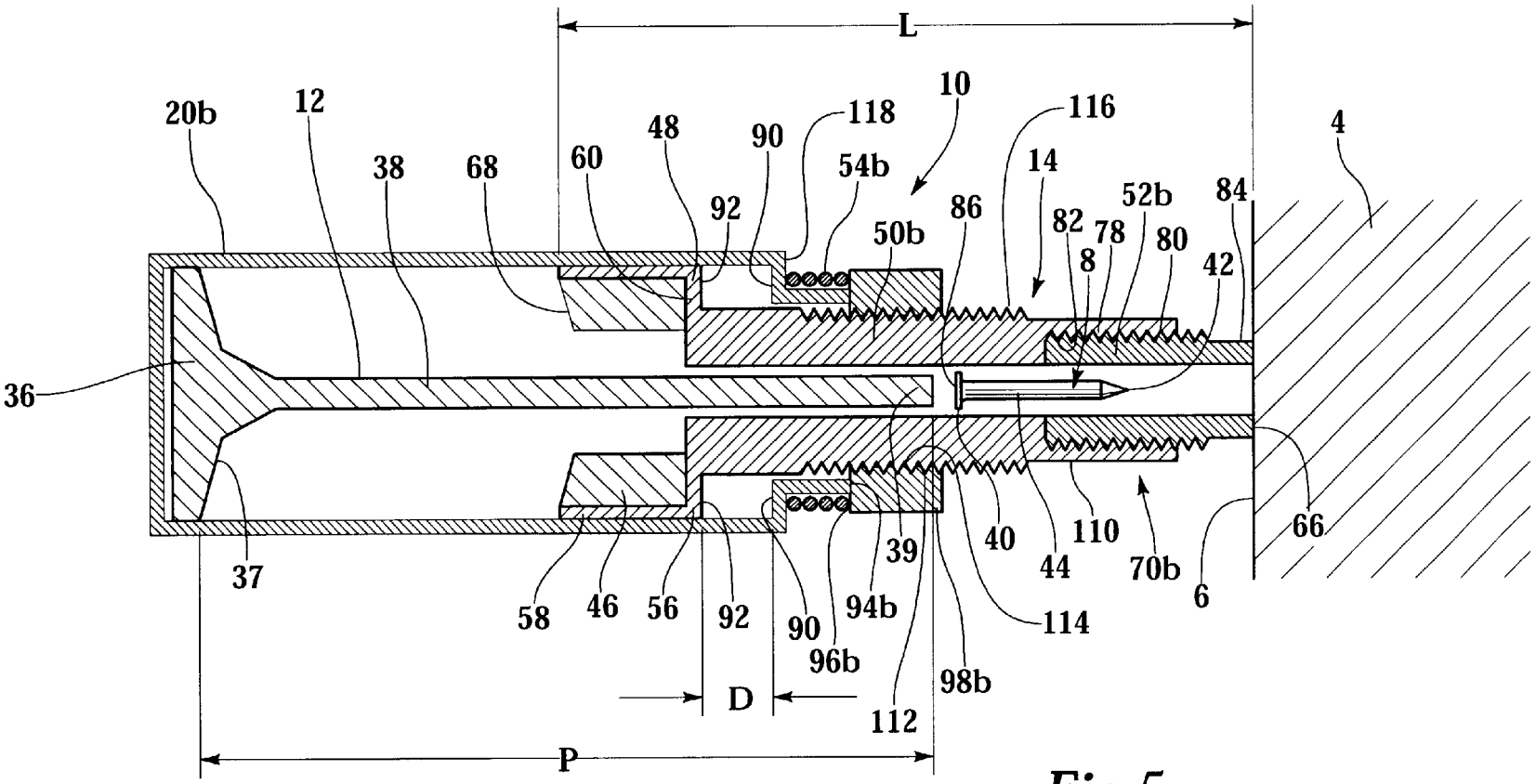
FIG. 5 is a side-sectional view of a second embodiment of the depth control (shown without the tool housing) before the fastener driving tool is actuated.

Returning to FIG. 3, substrate contacting surface 66 is pushed against substrate 4 so that tool body 20*b* is pushed in the driving direction so that depth control probe 14 is in its retracted position where stopping surface 96*b* is in contact with spacing surface 94*b*, as shown in FIG. 5, creating a gap between recoil surface 92 and lifting surface 90 having the same distance D.

When tool 2 is actuated, piston 12 is driven in the driving direction and tool body 20*b* recoils in the trailing direction while spring 54*b* biases depth control probe 14 to remain against substrate 4. Eventually the gap between lifting surface 90 and recoil surface 92 will be closed and lifting surface 90 will come into contact with recoil surface 92, as in FIG. 6. Tool body 20*b* still contains sufficient momentum to continue moving in the trailing direction so that lifting surface 90 engages recoil surface 92 to lift depth control probe 14 off substrate 4.

The method by which adjustable depth control 10 controls the driving depth of fastener 8 in substrate 4 includes the steps of pushing depth control probe 14 against surface 6 of substrate 4 so that depth control probe 14 is in the retracted position, firing tool 2 so that piston 12 is driven in the driving direction, driving a fastener 8 in the driving direction with piston 12, and hitting trailing surface 68 of bumper 46 with piston 12 so that the motion of piston 12 in the driving direction is stopped by bumper 46.

As shown in FIG. 5, pushing substrate contacting surface 66 of depth control probe 14 against surface 6 of substrate 4 forces tool body 20*b* in the driving direction. Because spacing surface 94*b* is operationally associated with tool body 20*b*, it moves in the driving direction as well until spacing surface 94*b* is pushed into stopping surface 96*b*. When stopping surface 96*b* comes into contact with spacing surface 94*b*, the motion of tool body 20*b* in the driving direction is stopped. Lifting surface 90 also moves in the driving direction until tool body 20*b* stops. At this point, recoil surface 92 has been axially spaced away from lifting surface 90 by a distance D due to the motion in the driving direction of tool body 20*b*.

Firing fastener driving tool 2, as shown in FIG. 6, causes piston 12 to be driven in the driving direction and causes tool body 20*b* to recoil in the trailing direction. Piston 12 and fastener 8 are guided in the driving direction by depth control probe 14 toward substrate 4. Tool body 20*b* recoils and the distance D between lifting surface 90 and recoil surface 92 is closed so that depth control probe 14 changes from the retracted position, shown in FIG. 5, to the extended position, shown in FIG. 6, relative to tool body 20*b*.

Lifting surface 90 is operationally associated with tool body 20*b* so lifting surface 90 is also recoiled in the trailing direction until lifting surface hits recoil surface 92. Tool body 20*b* and lifting surface 90 continue to move in the trailing direction, causing a lifting of depth control probe 14 to occur because lifting surface 90 lifts recoil surface 92, and when recoil surface 92 moves, so does depth control probe 14. A completed lifting step is shown in FIG. 6.

As described above, and shown in FIG. 6, driving surface 37 of piston head 36 hits bumper 46, stopping the driving motion of piston 12, and stopping the driving of fastener 8 into substrate 4. Depth control probe 14 creates a space having a predetermined length L between substrate surface 6 and trailing surface 68 of bumper 46 at trailing end 56. Depth control adjustment 70*b* allows the effective length L of depth control probe 14 to be changed so that the predetermined length L of the space between substrate surface 6 and trailing surface 68 of bumper 46 can be adjusted axially. Adjusting the predetermined length is accomplished by axially adjusting adjustable portion 52*b* with respect to trailing portion 50*b* of depth control probe 14.

The depth of drive control of the present invention advantageously combines an improved method of controlling the driving depth of a fastener into a substrate with a method of lifting the depth control probe off the surface of the substrate. The inventive depth of drive control exploits the tool's own recoil to provide to lift the tool off the surface of the substrate, effectively controlling the formation of an impact mark on the surface of the substrate.

The present invention is not limited to the above-described embodiments, but should be limited solely by the following claims.

What is claimed is:

1. A fastener driving tool for axially driving a fastener, comprising:

a gun body having a cylinder with an axis, the cylinder enclosing a piston, wherein the piston is driven in a driving direction; and a depth control probe;

a bumper movable with the depth control probe, the bumper having a trailing surface;

wherein the depth control probe is movable relative to the gun body between an extended position and a retracted position;

wherein the bumper is in a trailing position relative to the gun body when the depth control probe is in the retracted position and the bumper is in a leading position relative to the gun body when the depth control probe is in the extended position;

wherein the depth control probe creates a space having a predetermined length between a surface of a substrate and the trailing surface of the bumper; and wherein a surface of the piston hits the trailing surface of the bumper after the fastener is driven.

2. A fastener driving tool according to claim 1, wherein a portion of the depth control probe is axially adjustable with respect to the gun body.

3. A fastener driving tool according to claim 1, wherein the depth control probe includes a substrate contacting surface, and wherein the depth control probe is in the retracted position when the substrate contacting surface is pushed against a substrate.

4. A fastener driving tool for axially driving a fastener, comprising:

a gun body having a cylinder with an axis, and a lifting surface movable with the gun body, the cylinder enclosing a piston, wherein the piston is driven in a driving direction;

a depth control probe;

a bumper movable with the depth control probe, the bumper having a trailing surface and a recoil surface movable with the depth control probe;

wherein the depth control probe is movable relative to the gun body between an extended position and a retracted position;

wherein the recoil surface is spaced away from the lifting surface when the depth control probe is in the retracted position, and wherein the lifting surface is proximate the recoil surface when the depth control probe is in the extended position;

wherein the depth control probe creates a space having a predetermined length between a surface of a substrate and the trailing surface of the bumper; and wherein a surface of the piston hits the trailing surface of the bumper after the fastener is driven.

5. A fastener driving tool according to claim 4, wherein the recoil surface is associated with a trailing end of the depth control probe.

6. A fastener driving tool according to claim 4, wherein the lifting surface is in contact with the recoil surface when the depth control probe is in the extended position.

7. A fastener driving tool according to claim 4, wherein there is a gap having a predetermined distance between the recoil surface and the lifting surface when the depth control probe is in the retracted position.

8. A fastener driving tool according to claim 7, further comprising a spacing surface operationally associated with the gun body and a stopping surface operationally associated with the depth control probe, wherein the stopping surface is in contact with the spacing surface when the depth control probe is in the retracted position and wherein there is a gap having the predetermined distance between the stopping surface and the spacing surface when the depth control probe is in the extended position.

9. A fastener driving tool according to claim 4, wherein the lifting surface faces generally away from the driving direction.

10. A fastener driving tool according to claim 4, wherein the recoil surface faces generally in the driving direction.

11. A fastener driving tool according to claim 4, wherein the gun body further comprises a radially inwardly extending shoulder and the depth control probe further comprises a radially outwardly extending flange, wherein a portion of the depth control probe is radially spaced inside a portion of the gun body, and wherein the lifting surface is on the radially inwardly extending shoulder of the gun body and the recoil surface is on the radially outwardly extending flange of the depth control probe.

12. A fastener driving tool according to claim 4, wherein the gun body moves in a direction generally opposite the driving direction after the fastener driving tool has been actuated.

13. A fastener driving tool according to claim 12, wherein the gun body moves so that the depth control probe changes from the retracted position to the extended position, and wherein the depth control probe remains generally stationary and guides a fastener while the gun body moves between the retracted and extended position.

14. A fastener driving tool according to claim 12, wherein the gun body moves so that the depth control probe changes from the retracted position to the extended position so that the lifting surface contacts the recoil surface and lifts the depth control probe off the substrate.

15. A fastener driving tool for axially driving a fastener, comprising:

a gun body having a cylinder with an axis, the cylinder enclosing a bumper and a piston, wherein the piston is driven in a driving direction;

wherein the gun body includes a lifting surface;

a depth control probe having a substrate contacting surface, and a recoil surface, wherein the bumper is movable with the depth control probe;

wherein the depth control probe is movable with respect to the gun body between a retracted position and an extended position;

wherein the recoil surface is spaced away from the lifting surface and the substrate contacting surface is in contact with a substrate when the depth control probe is in the retracted position; and wherein the lifting surface is in contact with the recoil surface, the substrate contacting surface is not in contact with the substrate, and the bumper is in contact with the piston when the depth control probe is in the extended position.

* * * * *